US008568180B1

(12) United States Patent
DeHoney

(10) Patent No.: US 8,568,180 B1
(45) Date of Patent: Oct. 29, 2013

(54) STACKABLE MOORING BUOY

(75) Inventor: James M. DeHoney, Pasadena, CA (US)

(73) Assignee: Cal-June, Inc., No. Hollywood, CA (US)

( * ) Notice: Subject to any disclaimer, the term of this patent is extended or adjusted under 35 U.S.C. 154(b) by 215 days.

(21) Appl. No.: 13/167,679

(22) Filed: Jun. 23, 2011

(51) Int. Cl.
*B63B 22/00* (2006.01)
*B63B 22/02* (2006.01)

(52) U.S. Cl.
USPC ..... 441/1; 441/3

(58) Field of Classification Search
USPC ..... 441/1, 3, 6–13, 23–27; 114/230.1, 114/230.15, 230.2; D10/107, 113.2
See application file for complete search history.

(56) References Cited

U.S. PATENT DOCUMENTS 3,060,463 A * 10/1962 Pentzien ..... 114/292
3,286,680 A * 11/1966 Caretta ..... 114/219
3,942,203 A * 3/1976 Perkins ..... 441/28
7,001,233 B2 * 2/2006 Gotell ..... 441/1

OTHER PUBLICATIONS

Jim-Buoy Catalog, Division of Cal-June, Inc., PO Box 9551, No. Hollywood, CA.

* cited by examiner

*Primary Examiner* — Ajay Vasudeva
(74) *Attorney, Agent, or Firm* — Roy L. Anderson; Wagner, Anderson & Bright, P.C.

(57) ABSTRACT

A mooring buoy for use in water having a lower portion with a substantially cylindrical outer surface and a bottom surface with a female stacking indent and an upper portion having a radiused outer surface and a male stacking ridge so two such mooring buoys can be stacked and sit atop each other when the mooring buoys rest on a planar surface. Handles can be formed in the lower portion.

8 Claims, 3 Drawing Sheets

STACKABLE MOORING BUOY

FIELD OF THE PRESENT INVENTION

The present invention is in the field of mooring buoys.

BACKGROUND OF THE INVENTION

There are several different types of water or marine buoys, each designed for a specific purpose and use and there are often regulations or laws governing use of different types of such buoys. The present invention is not concerned with marine buoys in general, but is only concerned with one specific type of marine buoy that has a specific use and application—a mooring buoy.

A mooring buoy is used in a mooring system.

A mooring system allows a boat to remain secured when unattended by tying into the mooring system instead of using an anchor. Each mooring system will generally have a mooring anchor, a mooring buoy and a length of chain running between the mooring anchor and the mooring buoy. The mooring anchor is permanently affixed to a ground bottom while the mooring buoy floats the chain and provides surface site identification. The mooring system will also have galvanized shackles and swivels that are sized for the system.

There are generally two general types of a mooring buoy. A first type of mooring buoy comes complete with hardware while the second type of mooring buoy has a tube through its center.

A mooring buoy should be sized to accommodate the chain it is floating, which is a function both of depth of the water and size of boat to be moored. Because mooring buoys are not used for navigational purposes, they do not need to protrude far out of the water, as is the case with navigational or marker buoys. Traditional mooring buoys have a circular shape that maximizes floating capacity.

SUMMARY OF THE INVENTION

The present invention is generally directed to a mooring buoy for use in water having a lower portion with a substantially cylindrical outer surface and a bottom surface with a female stacking indent and an upper portion having a radiused outer surface and a male stacking ridge so two such mooring buoys can be stacked and sit atop each other when the mooring buoys rest on a planar surface.

In a separate group of aspects of the present invention, handles can be formed in the cylindrical outer surface of the lower portion of the mooring buoy which can have a substantially planar, circular, bottom surface and a band recess can be formed between the lower and the upper portions. The mooring buoy can have a tube located centrally in it and a pocket located in its upper portion extending upwardly and outwardly away from an upper portion of the tube.

Accordingly, it is a primary object of the present invention to provide an improved mooring buoy for use in a body of water.

This and further objects and advantages will be apparent to those skilled in the art in connection with the drawings and the detailed description of the invention set forth below.

BRIEF DESCRIPTION OF THE DRAWINGS

FIG. 1 illustrates a mooring buoy according to the present invention while

DETAILED DESCRIPTION OF THE INVENTION

The present invention is generally directed to a mooring buoy useful in a mooring system. Unlike conventional mooring buoys, a mooring buoy according to an especially preferred embodiment of the present invention can easily be stacked when not in use out of the water and it has handles for ease of movement. Key to such functionality is a shape that differs from conventional mooring buoys in that the lower portion of the mooring buoy has a cylindrical shape and a stacking recess for mating with a stacking protrusion in the upper half of the mooring buoy formed around a generous pocket which also helps keep mooring hardware and lines out of the water.

Just as traditional mooring buoys can be made with or without a tube in the center of the mooring buoy, the present invention can also be made with or without a tube in the center of the mooring buoy, although only the latter embodiment is illustrated in the Figures.

Figure 2:
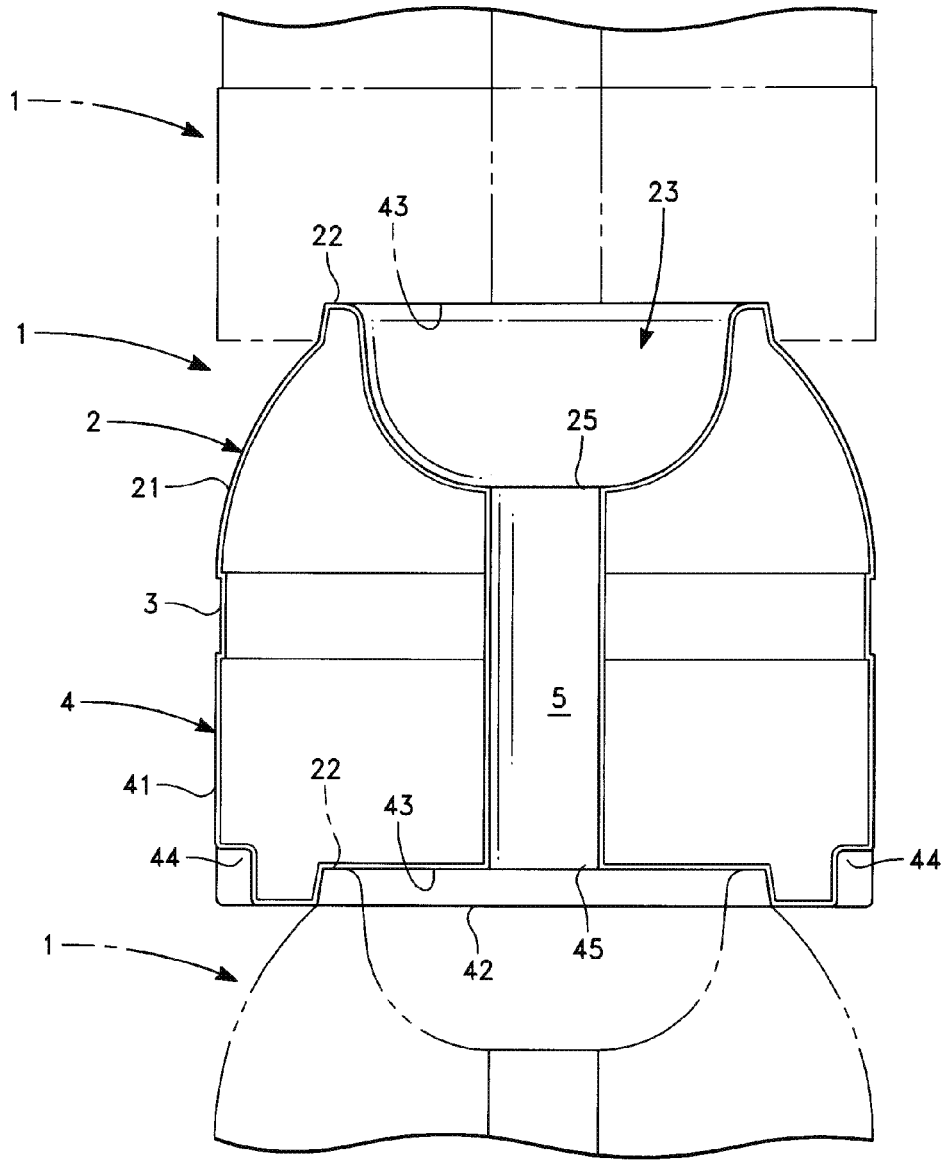
FIG. 2 provides a cross section of such a mooring buoy and also illustrates two such buoys in a stacked relationship.
Figure 3:
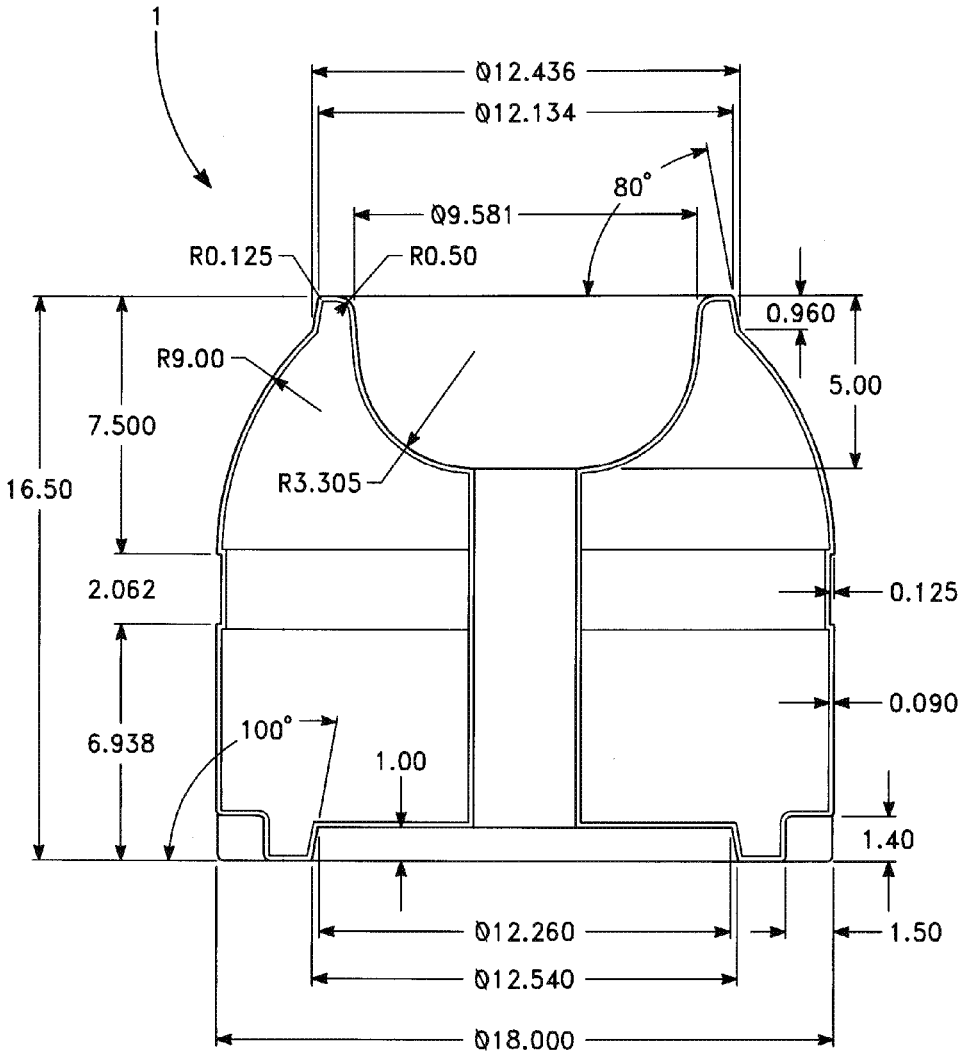
FIG. 3 provides dimensions for one example of an especially preferred embodiment of the present invention

The present invention will now be discussed in connection with a preferred embodiment illustrated in FIGS. 1-3.

In the Figures and the following more detailed description, numerals indicate various features of the invention, with like numerals referring to like features throughout both the drawings and the description. Although the Figures are described in greater detail below, the following is a glossary of the elements identified in the Figures:

| | |
|---|---|
| 1 | mooring buoy |
| 2 | upper portion of mooring buoy 1 |
| 3 | band recess |
| 4 | lower portion of mooring buoy 1 |
| 5 | tube |
| 21 | upper portion radiused outer surface |
| 22 | upper portion male stacking ridge |
| 23 | upper portion pocket |
| 25 | upper portion tube edge |
| 41 | lower portion cylindrical outer surface |
| 42 | lower portion bottom surface |
| 43 | lower portion female stacking indent |
| 44 | lower portion handle |
| 45 | lower portion tube edge |

Figure 1:
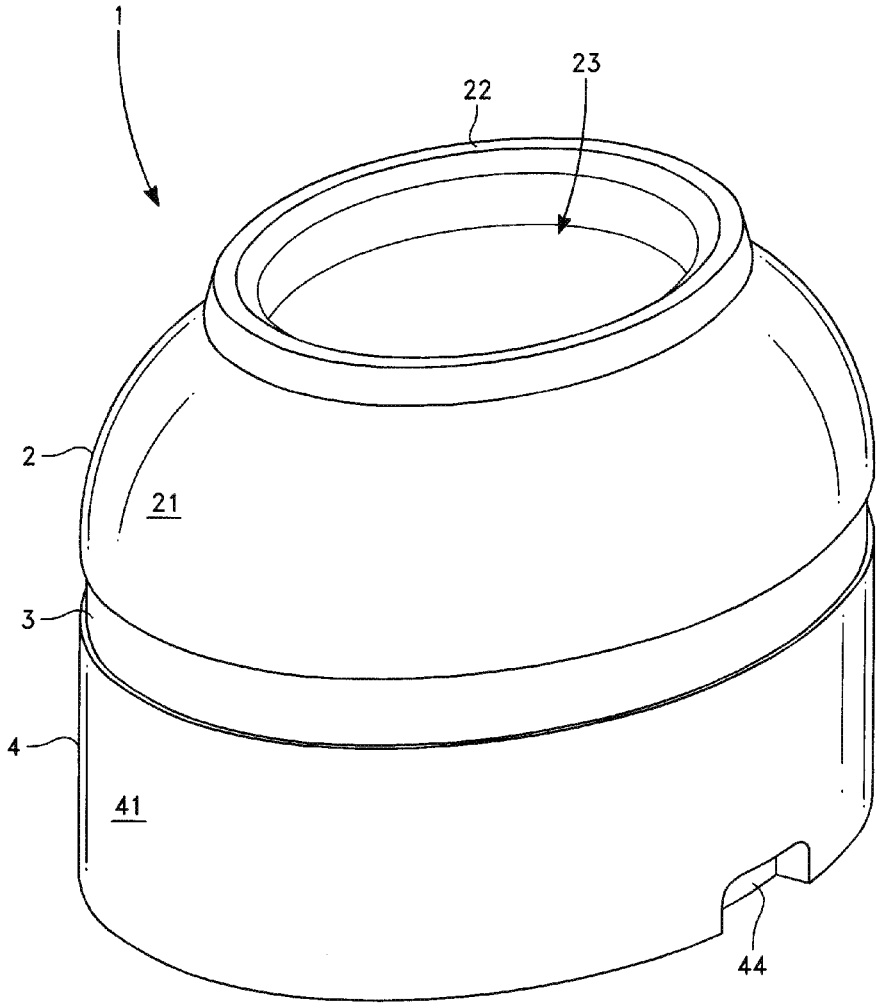

As illustrated in the FIG. 1, an especially preferred mooring buoy 1 according to the present invention has an upper portion 2, a lower portion 4 and a band recess 3. Band recess 3 is used to accommodate a blue strip that is used to designate buoy 1 as a mooring buoy. Tube 5 is located in the center of mooring buoy 1 to accommodate a mooring chain running from beneath the mooring buoy in water going from lower portion tube edge 45 up to upper portion tube edge 25 where the mooring chain can be secured by mooring hardware inside of upper portion pocket 23 which is also sized to accommodate holding such mooring hardware (to prevent it from hitting boats) and to also accommodate a mooring penant line and keep it out of the water.

Upper portion 2 of mooring buoy 1 is shaped similarly to traditional mooring buoys except for its pocket 23 and male stacking ridge 22 extending upwardly from pocket 23. Upper portion 2 has radiused outer surface 21 extending upwardly and inwardly until it meets male stacking ridge 22 which breaks the radius and extends upwardly therefrom to create a stacking ridge designed to mate with female stacking indent 43. From the top of stacking ridge 22, pocket 23 extends down and inwardly, in a bowl shape, until it culminates in a central inner location where tube edge 25 is located.

Lower portion 4 of mooring buoy 1 is not shaped similarly to traditional mooring buoys. Rather than having a rounded or spherical shape, it has a cylindrical shape that extends downwardly from band recess 3 in the form of cylindrical outer surface 41 until it meets a planar bottom surface 42 which is interrupted by female stacking indent 43 that extends inwardly (i.e., upwardly toward upper portion 2) so as to create a female mating indent for male stacking ridge 22. For ease of handling, handles 44 can be formed in cylindrical outer surface 41 and, in an especially preferred embodiment of the present invention, such handles are formed at the lower end of cylindrical outer surface 41 because of ease of manufacturing handles at such location, although handles located further up cylindrical outer surface 41 will serve the same function. The cylindrical shape of outer surface 41 helps mooring buoy 1 to float all by itself and not dump gear in its pocket 23 into the water when tension is lessened on the buoy (which might be caused by a low water level that would otherwise cause a traditional round mooring buoy to flop over).

When one remembers that mooring buoys can be rather large in size, and also that they need to be stable since they are being used in a mooring system to replace an anchor, advantages of the present invention flow from the above description.

While mooring buoys are in water, they serve their purpose. However, mooring buoys must be manufactured and ultimately get to an end user who places them in water, and such mooring buoys are often removed, in certain locations, for winter storage. When such mooring buoys are not in the water, they pose handling issues not only in terms of moving them around, but also in terms of storage. In this regard, traditional mooring buoys, having a round ball shape, are not stackable onto themselves. By contrast, mooring buoys according to the present invention can be stacked upon themselves, as is illustrated in FIG. 2. This is a tremendous advantage in terms of ease of transportation, handling and storage. Moreover, when mooring buoys according to the present invention have handles, such handles greatly facilitate ease of handling, including ease of stacking and removing mooring buoys from stacks of such mooring buoys.

The present invention is further illustrated in connection with an especially preferred embodiment of the present invention which is also an actual commercial embodiment of the present invention. FIG. 3 sets forth the dimensions for one example of a mooring buoy shown in FIGS. 1-2. Upper and lower portions 2 and 4 of such a mooring buoy are made by roto-molding out of polyethylene and polyurethane foam and tube 5 is made of PVC. The total weight of such a mooring buoy is fourteen pounds for an eighteen inch diameter mooring buoy, twenty-eight pounds for a twenty-four inch diameter mooring buoy and fifty pounds for a thirty inch diameter mooring buoy.

While the invention has been described herein with reference to certain preferred embodiments, those embodiments are presented by way of example only, and not to limit the scope of the invention. For example, male stacking ridge 22 and female stacking indent 43 are shown as being continuous and having a circular cross section because such shapes are especially preferred from a manufacturing standpoint however, either the male stacking ridge or the female stacking indent or both of them, could have a different shape without departing from the scope of the present invention. Thus, additional embodiments that practice the inventive concepts described herein will be obvious to those skilled in the art having the benefit of this detailed description.

Accordingly, it will be apparent to those skilled in the art that still further changes and modifications in the actual concepts described herein can readily be made without departing from the spirit and scope of the disclosed inventions.

What is claimed is:

1. A mooring buoy for use in water a body of water, comprising:

a substantially circumferential band recess;

a lower portion of the mooring buoy located below the band recess when the mooring buoy is in use in the body of water having a substantially cylindrical outer surface and a bottom surface with a female stacking indent; and an upper portion of the mooring buoy located above the band recess the mooring buoy is in use in the body of water having a radiused outer surface and a male stacking ridge located above the radiused outer surface;

wherein the male stacking ridge of a first mooring buoy will mate with the female stacking indent of a second buoy so that the second mooring buoy can be stacked and sit atop the first mooring buoy when the first mooring buoy is resting on a planar surface; and wherein the lower portion of the mooring buoy provides floatation to keep the user portion of the mooring buoy above the body of water and the radiused outer surface has an upper portion diameter which is less than a lower portion diameter of the substantially cylindrical outer surface, and wherein the upper portion diameter is more than a maximum diameter of the stacking ridge.

2. The mooring buoy of claim 1, further comprising:

a plurality of handles formed in the substantially cylindrical outer surface.

3. The mooring buoy of claim 1, wherein the bottom surface is substantially planar.

4. The mooring buoy of claim 1, wherein the male stacking ridge has a substantially circular planar cross section.

5. The mooring buoy of claim 1, further comprising: a tube located centrally in the lower and the upper portions: and a pocket located in the upper portion extending upwardly and outwardly away from an upper portion of the tube.

6. A mooring buoy for use in a body of water, comprising:

a substantially circumferential band recess;

a lower portion of the mooring buoy located below the band recess when the mooring buoy is in use in the body of water having a substantially cylindrical outer surface and a bottom surface with a female stacking indent:

an upper portion of the mooring buoy located above the band recess when the mooring buoy is in use in the body of water having a radiused outer surface, a male stacking ridge located above the radiused outer surface, and a pocket, and a tube extending centrally through the lower and the upper portions substantially parallel to the substantially cylindrical outer surface, wherein the male stacking ridge of a first mooring buoy will mate with the female stacking indent of a second buoy so that the second mooring buoy can be stacked and sit atop the first mooring buoy when the first mooring buoy is resting on a planar surface;

wherein the radiused outer surface extends upwardly and inwardly away from the substantially cylindrical outer surface toward the male stacking ridge and the pocket extends downwardly and inwardly away from a top surface of the male stacking ridge;

wherein the lower portion of the mooring buoy provides floatation to keep the upper portion of the mooring buoy above the body of water and the radiused outer surface has an upper portion diameter which is less than a lower portion diameter of the substantially cylindrical outer surface, and wherein the upper portion diameter is more than a maximum diameter of the stacking ridge.

7. The mooring buoy of claim 6, further comprising:

a plurality of handles formed in the substantially, cylindrical outer surface.

8. The mooring buoy of claim 7, wherein the bottom surface is substantially planar.

* * * * *